166-273 SR
3/6/84 OR 4,434,852

United States Patent [19]
Morel et al.

[11] 4,434,852
[45] Mar. 6, 1984

[54] METHOD OF ENHANCED OIL RECOVERY EMPLOYING NITROGEN INJECTION

[75] Inventors: Thomas J. Morel; Stewart Haynes, Jr.; Jack H. Park, all of Houston, Tex.

[73] Assignee: Texaco Inc., White Plains, N.Y.

[21] Appl. No.: 297,805

[22] Filed: Aug. 31, 1981

[51] Int. Cl.[3] ..... E21B 43/22
[52] U.S. Cl. ..... 166/273; 166/268
[58] Field of Search ..... 166/266, 267, 268, 273, 166/274

[56] References Cited

U.S. PATENT DOCUMENTS

| | | | |
|---|---|---|---|
| 1,978,655 | 10/1934 | Straight | 166/266 X |
| 3,209,824 | 10/1965 | Koch, Jr. et al. | 166/268 |
| 3,245,467 | 4/1968 | Fitch | 166/273 |
| 3,386,506 | 6/1968 | Quance | 166/273 |
| 3,811,501 | 5/1974 | Burnett et al. | 166/273 X |
| 4,299,286 | 11/1981 | Alston | 166/274 |

*Primary Examiner*—George A. Suchfield
*Attorney, Agent, or Firm*—Jack H. Park; Carl G. Ries

[57] ABSTRACT

Disclosed is a process for the recovery of oil from a subterranean oil reservoir by miscible displacement using a predominantly nitrogen-containing gaseous displacing fluid which may contain lesser quantities of carbon dioxide. The miscibility of the first portion of the gaseous displacing phase injected into the formation is greater than the miscibility of the subsequent portion, as a consequence of increased concentrations of carbon dioxide and/or normally liquid hydrocarbons for the purpose of decreasing the time and distance which the gaseous nitrogen-containing displacing fluid must travel into the reservoir before attaining a conditionally miscible transition zone at reservoir conditions of temperature and pressure. The concentration of carbon dioxide and/or normally liquid hydrocarbons may be decreased in a reverse taper function, after which essentially pure nitrogen or nitrogen containing only minimal amounts of more soluble components may be injected into the formation.

8 Claims, No Drawings

METHOD OF ENHANCED OIL RECOVERY EMPLOYING NITROGEN INJECTION

FIELD OF THE INVENTION

This invention relates to the recovery of oil from subterranean oil reservoirs and more particularly, to enhanced oil recovery operations in which nitrogen and light hydrocarbons are injected into the reservoir to achieve conditionally miscible displacement of the oil therein.

BACKGROUND OF THE INVENTION

In the recovery of oil from oil bearing reservoirs, it usually is possible to recover only minor portions of the original oil in place by the so-called primary recovery methods which utilize only the natural forces present in the reservoir. Thus, a variety of supplemental recovery techniques have been employed in order to increase the recovery of oil from subterranean reservoirs. These supplemental techniques, commonly referred to as "enhanced oil recovery", involve the injection of a fluid, or series of fluids, into the reservoir through an injection system comprised of one or more wells. As the injected fluid moves through the reservoir, it acts to displace the oil therein, to a production system composed of one or more wells through which the oil is recovered.

One type of enhanced oil recovery procedure involves miscible flooding in which an oil miscible solvent is injected into the formation. The solvent is forced through the formation by a suitable driving fluid, which may be gaseous or liquid depending upon the nature of the solvent, and acts to displace the oil to the production system. The miscible displacement mechanism may involve "first contact miscibility" or "conditional miscibility". In first contact miscibility, the miscible displacing agent normally takes the form of a light hydrocarbon slug such as pentane, propane or butane, or mixtures of such hydrocarbons, commonly termed "liquified petroleum gas" (LPG). The injected liquid hydrocarbon is capable of forming a single phase with the reservoir oil at the reservoir conditions immediately upon contact therewith. In conditional miscibility, a miscible transition zone is formed in the reservoir as a result of repeated contact of the reservoir oil by an injected high pressure gas. The transition zone of conditional miscibility may be formed of light hydrocarbons present in injected gas, referred to as enriched gas, or light hydrocarbons may be stripped from the reservoir oil by an injected lean gas.

PRIOR ART

A number of procedures for oil recovery by conditionally miscible displacement described in published literature involve the injection of carbon dioxide under a suitable high pressure. The carbon dioxide may be employed alone or in conjunction with other materials to establish a conditionally miscible transition zone within the reservoir. As disclosed in U.S. Pat. No. 4,136,738 to Haynes et al, carbon dioxide may be injected into the reservoir subsequent to the injection of a light hydrocarbon. The light hydrocarbon slug, e.g. a mixture of $C_2$–$C_6$ aliphatic hydrocarbons, is injected at a rate in excess of a "critical velocity" to ensure mixing of the light hydrocarbon with the reservoir oil. As a result of this mixing, the reservoir oil is altered such that it is conditionally miscible with the subsequently injected carbon dioxide at the reservoir temperature and pressure. Thereafter, the carbon dioxide is injected at a relatively low rate which is less than the critical velocity in order to form the conditionally miscible transition zone.

Various so-called inert gases may be employed to establish oil displacement by conditional miscibility. For example, a paper by M. D. Rushing et al, entitled "Miscible Displacement with Nitrogen", Petroleum Engineer, November 1977, pp. 26–30, describes a miscible oil displacement process involving the injection of high pressure nitrogen. As disclosed by Rushing et al, pure nitrogen is injected into the reservoir and functions to initially strip relatively low molecular weight hydrocarbons from the reservoir oil. As the light hydrocarbons are absorbed, a two-phase equilibrium point is established between the reservoir oil and the nitrogen at a location near the injection well. The liquid phase is composed initially of significant quantities of light and heavy residual hydrocarbons, whereas the gas phase is comprised primarily of nitrogen and light hydrocarbons. Since the gas phase has a higher mobility within the reservoir, it moves ahead of the liquid phase to contact additional reservoir oil. As nitrogen injection continues, the liquid phase is contacted with additional nitrogen with an attendant decrease in the concentration of light hydrocarbons in the liquid phase until ultimately the liquid phase is reduced to the heavy residual hydrocarbons.

Nitrogen and carbon dioxide may also be employed in admixture with one another or with other gases. For example, U.S. Pat. No. 3,811,501 to Burnett et al, disclosed an oil displacement process employing conditional miscibility in which the injected fluid comprises carbon dioxide and an inert gas having a solubility in the reservoir oil which is less than that of the carbon dioxide. Examples of inert gases which may be employed in the Burnett et al, process includes methane, natural gas, separator gas, flue gas, nitrogen and air.

In U.S. Pat. No. 4,008,764, J. C. Allen, there is disclosed an oil recovery process in which a carrier gas is used to vaporize a normally-liquid hydrocarbon solvent, and the gaseous mixture is injected into the reservoir. The only purpose served by the carrier gas is to transport the liquid solvent and gas miscibility is attained in the process.

In copending application Ser. No. 152,072 now U.S. Pat. No. 4,299,286, filed May 21, 1980, for "Enhanced Oil Recovery Employing Blend of Carbon Dioxide, Inert Gas and Intermediate Hydrocarbons", R. B. Alston, there is disclosed a method for recovering oil from dipping reservoirs by injecting a gaseous fluid which is predominantly carbon dioxide, with sufficient nitrogen or other inert gas blended therewith to adjust the gas density downward to a desired value, plus sufficient intermediate hydrocarbons to achieve at least conditional or multiple contact miscibility with the formation petroleum at reservoir conditions.

SUMMARY OF THE INVENTION

In accordance with the present invention, there is provided a new and improved miscible flood process involving the injection of a gaseous, conditionally miscible fluid which is at least 50% and preferably at least 75% nitrogen. The first 0.20, and preferably the first 0.10 pore volumes of fluid injected into the reservoir contains components which are more miscible with formation petroleum than nitrogen, such as a light hydrocarbon. The first injected fluid forms a transition zone of conditional miscibility within the resevoir. Subsequent to injection of the mixture of nitrogen and light hydrocarbon, a predominantly nitrogen-containing gas is introduced into the reservoir via the injection system. The nitrogen-containing gas is injected at a rate to produce a stable oil displacement zone moving within the formation. The injection of the predominantly nitrogen-containing gas is continued at this relatively stable rate sufficient to strip additional light hydrocarbon from the reservoir oil which, together with the light hydrocarbon, mixed with the original portion of enriched gas injected into the reservoir, form a transition zone of conditional miscibility within the reservoir. The process is carried to conclusion by the injection of a drive fluid into the reservoir to displace the crude oil to a suitable production system from which it is recovered.

DESCRIPTION OF SPECIFIC EMBODIMENTS

As noted previously, the injection of nitrogen gas can, under appropriate circumstances, result in the establishment of a miscible transition zone from the components in reservoir oil. In order for the injected nitrogen to become sufficiently rich in low molecular weight hydrocarbons from the formation crude oil to establish miscibility, a number of successive contacts of the enriched nitrogen and the reservoir oil must occur. The movement of the gas and liquid phases through the reservoir may be characterized as involving a chromatographic transport mechanism which produces gas-liquid chromatographic separation in the reservoir. The stripping of light to intermediate hydrocarbons from the reservoir oil with the attendant further enrichment of the injected nitrogen may be defined in terms of this chromatographic separation effect. Thus, the enrichment of the injected nitrogen can be related to the number of theoretical plates required for the attainment of gas-liquid equilibrium. By analogizing the reservoir to a packed column, the equivalent length of reservoir required for the attainment of gas-liquid equilibrium may be explained in terms of the "height equivalent to a theoretical plate" (HETP), familiar to those skilled in the art of liquid-vapor fractionation. The HETP is a function of the reservoir characteristics and is constant for a given reservoir. The number of equilibrium contacts between the gas and the reservoir oil multiplied by the HETP gives the length of the fluid flow path within the reservoir needed to establish sufficient additional enrichment of the injected enriched nitrogen to produce the in situ transition zone which is miscible in both the gas phase and the reservoir oil. The length of this path at pressures and temperatures normally encountered in subterranean reservoirs is much longer for nitrogen than for carbon dioxide. For example, for a typical reservoir oil having a stock tank API gravity of 35.6° at a temperature of 164° F. and 3334 psia, the path length needed to achieve a conditionally miscible state through the injection of pure carbon dioxide would be about 4–5 feet. Where pure nitrogen, rather than carbon dioxide is employed as the injection gas, the path length needed to establish a conditionally miscible transition zone adjacent the injection system is increased materially to a value on the order of 100 feet or more. In the practice of the present invention, the distance traveled by nitrogen before formation of the conditionally miscibility is attained is materially diminished, this process, therefore, enables the use of nitrogen to establish a conditionally miscible transition zone relatively close to the injection well without resort to pressures significantly greater than those normally encountered in subterranean oil reservoirs. It is desirable to reduce the distance required to attain conditional miscibility to a value less than twenty percent and preferably less than ten percent of the distance between the injection well and the producing well.

In accordance with the present invention, the portion of the nitrogen displacement fluid injected into the reservoir via the injection system is altered in a manner which enhances the enrichment process leading to formation of the conditionally miscible transition zone. By adding a quantity of $C_2-C_6$ hydrocarbons, i.e. ethane, propane, butane, pentane, hexane and mixtures thereof, to the predominantly nitrogen displacing fluid injected into the injection well, the minimum pressure required to achieve miscibility at the reservoir temperature is decreased; or at a given set of reservoir conditions of pressure and temperature, the path length necessary to establish the conditionally miscible transition zone is decreased. The initial light hydrocarbon-enriched gaseous slug is injected at about the same rate as unenriched nitrogen would be injected into the formation. Only a small portion of the total volume of nitrogen or mixture of nitrogen and carbon dioxide to be used in our process is enriched with light hydrocarbon in the practice of this invention. Thus, the quantity of hydrocarbon required for enriching the gaseous displacing medium is substantially less than would be the case if the total quantity of gas to be injected into the formation were to be enriched.

The total volume of hydrocarbon-enriched nitrogen is from 0.01 to 0.20 and preferably from 0.02 to 0.10 pore volumes. In another embodiment, the quantity of enriched gas to be used on our process is based on the pore volume of a segment of the reservoir corresponding to a cylinder whose radius is from 10 to 100 and preferably 20 to 50 feet, in order to insure that the portion of gas injected into the first segment of the reservoir immediately adjacent to the injection well contains sufficient quantities of miscible components, e.g. the light hydrocarbon fractions mixed therewith, in order to reduce the path length required for attaining miscibility by subsequently injected nitrogen, to a value in the range from 5 to 50 feet. For example, at the reservoir conditions of 164° F. and 3334 psia, injection of essentially pure nitrogen (without any miscible components mixed therewith), would require a path length in the order of 100 feet or more before sufficient low molecular weight components are striped from the reservoir petroleum to enrich the nitrogen gas sufficiently to attain a condition of miscibility at realistic conditions of pressure and temperature within the reservoir. If the first portion of nitrogen gas injected into the reservoir is enriched with low molecular weight hydrocarbon fractions, the path length can be reduced to a value in the range from about 5 to 50 feet, depending upon the method of enrichment chosen, which will be discussed more fully below.

One preferred embodiment of our process involves the formation of a substantially single, gaseous phase mixture of nitrogen and liquid hydrocarbons. The hydrocarbon content in such instance is limited strictly by vapor pressure of the hydrocarbon and the injection temperature and pressure, and generally the maximum hydrocarbon content of such an enriched gas will be in the range from 2% to 20%.

In another embodiment, the fluid injected into the formation of the first portion of the oil recovery process involves a two-phase mixture of hydrocarbon and nitrogen or mixture of nitrogen and other gases such as carbon dioxide. By employing more liquid hydrocarbon than can be used to formulate a single gaseous phase mixture thereof, the amount of hydrocarbon injected into the formation in the very early stages of the process is increased, and so the time and distance required to attain miscibility between the subsequently injected nitrogen displacing fluid and the reservoir petroleum is substantially reduced. Passage of a multiphase fluid through the portion of the formation immediately adjacent to the reservoir increased the mixing action, and therefore increases the degree of mixing between the injected fluids and the formation petroleum, thereby reducing the time and distance required to achieve the conditionally miscible transition zone. Injection of a two-phase fluid is not particularly rate sensitive, and so the fluid may be injected at any convenient rate without attempting to influence mixing between an injected liquid slug and subsequently injected gaseous fluids.

In one embodiment of the process of our invention, essentially two separate gaseous slugs are injected into the formation. The first comprises the blend of nitrogen or nitrogen-rich gas and light hydrocarbons such as is described above, with the concentration of hydrocarbon being maintained essentially constant during the course of injecting that slug of fluid into the formation. After injection of the desired quantity of the mixture of nitrogen and hydrocarbon into the reservoir, injection of hydrocarbon is discontinued altogether and essentially gaseous nitrogen or mixture of nitrogen and other gases such as carbon dioxide is injected into the formation to displace the previously-injected hydrocarbon enriched nitrogen away from the formation. This has the advantage of simplifying the injection procedure and mixing equipment required.

In another preferred embodiment which is superior in at least certain applications, the degree of enrichment of nitrogen with light hydrocarbon is accomplished continually, according to a predetermined taper function from the maximum hydrocarbon content in the very first portion of gas injected into the formation, gradually decreasing to the minimum amount and then to zero as the injected fluid changes from hydrocarbon-enriched nitrogen to essentially pure nitrogen or mixture of nitrogen and other gases. Alternatively, the hydrocarbon content can be decreased from the maximum value to the minimum value in steps, so the fluid injection sequence is comprised of a plurality of very small slugs of gaseous mixtures of light hydrocarbon and nitrogen, with the hydrocarbon content of each slug injected into the reservoir being less than the hydrocarbon content of the slug injected immediately prior to it. Either the continuous decreasing taper in hydrocarbon content or the use of a plurality of small slugs with decreasing hydrocarbon content accomplishes a smooth transition between the initial enriched gas phase and the subsequently-injected lean nitrogen gas.

In another variation of any of the above embodiments a small slug of substantially pure liquid hydrocarbon may be injected into the formation prior to injection of the hydrocarbon-enriched nitrogen. The volume of hydrocarbon employed for this purpose is from 0.01 to 0.10 and preferably 0.02 to 0.5 pore volumes.

The amount of light hydrocarbon mixed with the gaseous fluid injected will vary depending upon the composition of the reservoir oil, the temperature and conditions of the reservoir oil, and the characteristics of the light hydrocarbon used. Usually it is preferred that the amount of light hydrocarbon mixed with nitrogen be from 2 to 20 and preferably 4 to 12 percent by volume based on the total volume of hydrocarbon and gas.

After the injection of a suitable quantity of the mixture of nitrogen and light hydrocarbon, nitrogen-containing gas which contains essentially no hydrocarbon is injected in order to establish the transition zone of conditional miscibility adjacent the injection wells. Any suitable predominantly nitrogen containing gas may be employed at this stage of the invention. For example, the injected gas may take the form of substantially pure nitrogen such as produced by cryogenic fractionation of air as described by Rothrock et al, "Nitrogen Floods Need Specialize Surface Equipment", *Petroleum Engineer,* August 1977, pp. 22–26. The nitrogen-containing gas may also take the form of flue gases such as from boilers or internal combustion engines which typically will contain about 88% nitrogen, 10% carbon dioxide, 1% carbon monoxide, and the remainder hydrogen and trace amounts of other gases. In some cases, where the reservoir oil does not contain readily oxidizable components which would be deleterious to the formation of a miscible zone, air (about 78% nitrogen) may be employed to form the conditionally miscible transition zone. The injected nitrogen may also contain other component gases in addition to those noted above. However, nitrogen must be the predominant component in the stripping gas employed in accordance with the present invention and preferably will comprise at least 75% of the injected gas.

The volume of nitrogen-containing gas injected in from 0.2–0.6 and preferably from 0.3 to 0.5 pore volume based on the volume of reservoir to be contacted with the gas.

As noted previously, the predominantly nitrogen-containing gas is injected at a rate which is sufficiently low to maintain the transition zone of conditional miscibility formed between the hydrocarbon-enriched nitrogen and the altered reservoir fluid as it is moved through the reservoir and displaces the oil therein. Usually it will be preferred to inject the nitrogenous gas at a rate resulting in a linear flow velocity within the reservoir within the range of 0.1–1.0 feet per day.

The nitrogenous gas is injected into the reservoir in an amount sufficient to maintain and propel the transition zone of conditional miscibility through the reservoir to the production system. Preferably, the nitrogenous gas is injected in an amount of at least 0.2 to 0.4 pore volume and is then followed by a suitable driving fluid which may comprise continued injection of the nitrogenous gas or may take the form of some other suitable gas which is compatible with the reservoir oil and the previously injected fluids. For example, the process may be carried out employing cryogenically produced nitrogen injected in an amount within the range of 0.2 to 0.4 pore volume followed by the injection of air in such amounts as necessary to carry the process to completion. While the process usually will be carried out employing only gas injection, in some instances, a liquid such as water may be employed as part of the driving agent. For example, water may be employed to increase the areal sweep efficieny of the process in the manner of the AGWIP (alternate gas water injection procedure) technique known to those skilled in the art, or water thickened with a suitable polymeric thickening agent may be injected for mobility control purposes.

The present invention may be carried out utilizing injection and production systems as defined by any suitable arrangement of wells extending from the surface of the earth into the subterranean oil reservoir. The wells may be located and spaced from one another in any desired pattern. One well arrangement commonly used in enhanced oil recovery operations and suitable for use in carrying out the present invention is the integrated five-spot pattern which comprises a plurality of five-spot patterns, each composed of a central production well and four corner injection wells. Another pattern often employed is the inverted five-spot pattern. Other suitable well arrangements which may be used in carrying out the invention include direct or staggered line drive patterns, four-spot, seven-spot, nine-spot patterns or circular flood patterns. For further description of these and other arrangements which may be employed in enhanced oil recovery operations, reference is made to Uren, Petroleum Production Engineering, Oil Field Exploitation, 3rd Ed., McGraw-Hill Book Company, Inc., New York 1953, pp. 528–534. While the well patterns are described in Uren with reference to water flooding operations, it will be rocognized that such patterns are also applicable to miscible flooding. The term "pore volume" is used herein to designate the pore volume of the formation underlying the well pattern defined by the wells comprising the injection and production systems.

It is also to be recognized that the invention may be carried out employing one or more dually completed injection-production wells of the type disclosed, for example, in U.S. Pat. No. 2,725,106 to Spearow. This arrangement may sometimes be utilized to advantage in relatively thick reservoirs in which it is desirable to displace the oil downwardly through the reservoir in a predominantly vertical direction and recover the oil from the lower portion of the reservoir.

The present invention may be carried out in an essentially flat reservoir where the oil displacement is fundamentally horizontal. However, another preferred application of the present invention is in reservoirs having a pronounced dip, i.e. 10° or more, where the gravitational effects due to the density differentials of the various fluids involved may be utilized to advantage. In this case, the light hydrocarbon and nitrogen are injected through one or more wells located up dip from the production wells. It will be understood by those skilled in the art that the term "dipping reservoir" is also meant to include relatively thick reservoirs, which may or may not exhibit a geological dip, but which are completed with wells so that the flow of fluids through the reservoir has a significant vertical component as described above with respect to the patent to Spearow.

The relative mobility of fluids flowing in a reservoir under a given pressure gradiant is directly proportional to the relative permeability of the reservoir to the fluids involved and inversely proportional to their viscosities. Accordingly, when a relatively viscous fluid such as reservoir oil is displaced with a fluid of relatively low viscosity, e.g. LPG, the flood front at the interface between the displaced and displacing fluids becomes progressively more unstable as the flow velocity increases. In addition, where a significant density differential exists between the displaced fluid and the displacing fluid, the stability of the flood front can be greatly influenced by gravitational forces. In carrying out a displacement recovery method in a dipping reservoir, the stability of the interface between a relatively dense displaced fluid and a relatively low density displacing fluid is enhanced by gravitational forces in the course of downdip fluid flow having a significant vertical component. Thus, as explained in the aforementioned patent to Haynes et al, for a given set of conditions there is a critical velocity below which downward displacement of the reservoir oil by a relatively low density displacing medium is stabilized by gravitational forces. This critical velocity, $V_c$, may be defined by the following relationship:

$$V_c = \frac{2.741\ \kappa\Delta\rho\ \mathrm{Sin}\alpha}{\phi\Delta\mu}$$

wherein:

$V_c$ is the critical velocity in feet per day, $\kappa$ is the permeability of the reservoir in darcies $\phi$ is the fractional porosity of the reservoir $=\phi_r(1-S_{wr}-S_{or})$, $\phi r$ is the porosity of the reservoir, $S_{wr}$ is the residual water saturation, $S_{or}$ is the residual oil saturation, $\alpha$ is the dip angle of the reservoir in degrees, $\Delta\rho$ is the density differential between the displaced fluid and the displacing fluid in grams per cubic centimeter, and $\Delta\mu$ is the viscosity differential between the displaced fluid and the displacing fluid in centipoise.

Consistent with the previous discussion, the reservoir dip angle may be considered to be the greater of the geological dip of the reservoir or, in the case of completion systems such as described above with respect to the patent to Spearow, the dip angle of the line of flight between the injection and production systems.

In carrying out the present invention in a dipping reservoir, the light hydrocarbon slug is injected at a rate to provide a velocity greater than the critical velocity, $V_c$. Preferably, the hydrocarbon-enriched gas slug is injected at a rate sufficient to provide a darcy velocity within the reservoir which is less than the critical velocity. Subsequent to the injection of the light hydrocarbon-enriched gas slug, the predominantly nitrogen-containing gas is injected at a rate to provide a darcy velocity which is less than critical velocity as defined by relationship (1). Preferably, the velocity of the injected nitrogenous gas is less than the critical velocity by a velocity increment of at least 0.2 feet per day. Subsequent to the injection of the desired quantity of predominantly nitrogen-containing gas, the process may be carried to completion by the continued injection of nitrogen or by a different driving agent as described previously.

EXAMPLES

For purpose of complete disclosure of best modes of applying the process of our invention, the following examples of applying our process are given.

A 50 foot thick reservoir located under 7350 feet of overburden contains oil having stock tank API gravity of 35.6° at a temperature of 164° F. and 3334 psia. The porosity of the reservoir is 42%. A five spot pattern in employed with an injection well in the center of a square grid each side of which is 200', with a production well of each corner of the square. The distance from the injection well to the production well is 141 feet. The areal sweep efficiency of such a pattern is 65%. The total pore volume of this pattern is therefore:

$$200 \times 200 \times 50 \times 0.65 \times 0.42 = 546{,}000 \text{ cu ft.}$$

Injection of pure nitrogen will not form the conditional misibility transition zone until about 100 feet from the injection well, which would bypass a sustantial portion of the oil in place in the reservoir.

In applying the process of our invention to this reservoir, it is decided to employ a first slug of hydrocarbon-enriched nitrogen corresponding in volume to a cylinder of radius 25 feet. The pore volume of this cylinder is:

$$\pi(25)^2\,(50)\,(0.42) = 41{,}233 \text{ cu ft.}$$

This volume of nitrogen is enriched by addition of 10 volume percent butane, 5,829,000 SCF (37,110 Reservoir cu ft.) of nitrogen which requires 4123 Reservoir cu ft. or 30,850 gallons of butane. One embodiment of our process, therefore, involves injecting 37,110 Reservior cu ft. of nitrogen and 30,850 gallons of butane as a single uniform slug, followed by injecting a 0.2 pore volume slug of pure nitrogen, which is 17,154,000 SCF or 109,200 reservoir cu ft. It can be seen that the volume of the enriched first slug is equivalent to 34% of the volume of pure nitrogen injected subsequently. Reservoir volume is determined from the following:

$$Bg = 0.005048\,\frac{ZT}{p}\,[Res.\,Bbl\,SCF] \times \frac{5.615\ \text{CuFt}}{Bbl} = 0.028344\,\frac{ZT}{p}$$

$$Z_{N2} = 1.20\ T = 164 + 460 = 624, p = 3334$$

$$Bg = 0.028344\,\frac{(1.20)(624)}{3334} = 0.006366\,\frac{Res\ CF}{SCF}$$

Finally, air is injected to displace oil and the previously injected fluids through the formations until oil production declines to such low values that further operation is uneconomical.

In another embodiment, the same total volume of enriched gas is employed, but the concentration of butane is decreased in a straight line taper function from an initial value of 20 volume percent to a final concentration of 0 percent during the injection of 0.05 pore volume of nitrogen, followed by injecting 0.15 pore volumes of nitrogen. This ensures even more rapid attainment of the conditionally miscible transition zone and smoother conversion to pure nitrogen injection.

In yet another, slightly different preferred embodiment of our process, the enriched gas is injected as five separate discrete slugs with the concentration of hydrocarbon being decreased in each successive slug as given below:

first slug = 8247 cu ft. $N_2$ + 10283 gallons butane second slug = 8247 cu ft. $N_2$ + 8227 gallons butane third slug = 8247 cu ft. $N_2$ + 6120 gallons butane fourth slug = 8247 cu ft. $N_2$ + 4113 gallons butane fifth slug = 8247 cu ft. $N_2$ + 2057 gallons butane In either of the last two embodiments the initial enriched gas injection phase is followed by first injecting pure nitrogen and then air as described above.

While the foregoing description of the process of our invention includes numerous specific illustrative embodiments, this is done for the purpose of full disclosure only and is not intended to be limitative or restrictive of the process of our invention, since many variations of the specific disclosures contained above will be apparent to persons skilled in the art without departing from the true spirit and scope of our invention. It is our intention that our invention be limited and restricted only by those limitations and restrictions appearing in the claims appending immediately hereinafter below.

We claim:

1. A method for the recovery of oil from a subterranean oil reservoir having a dip of at least 10 degrees and penetrated by spaced injection and production systems, comprising:

(a) injecting into said reservoir via said injection system at a location up dip from said production system, a first fluid comprising a mixture of nitrogen and from 2.0 to 20.0 percent by volume light hydrocarbon at rate sufficient to produce a flow velocity in said reservoir which is less than a critical velocity, $V_c$, as defined by the relationship:

$$V_c = \frac{2.741\ \kappa\Delta\rho\ \text{Sin}\alpha}{\phi\Delta\mu}$$

wherein:

$V_c$ is the critical velocity in feet per day, $\kappa$ is the permeability of the reservoir in darcies, $\phi$ is the fractional porosity of the reservoir $= \phi r(1 - S_{wr}S_{or})$, $\phi r$ is the porosity of the reservoir, $S_{wr}$ is the residual water saturation, $S_{or}$ is the residual oil saturation, $\alpha$ is the dip angle of the reservoir in degrees, $\Delta\rho$ is the density differential between the displaced, fluid and the displacing fluid in grams per cubic centimeter, and $\Delta\mu$ is the viscosity differential between the displaced fluid and the displacing fluid in centipoises;

(b) thereafter, injecting into said reservoir via said injection system a predominantly nitrogen containing gas at a rate to produce a flow velocity which is also less than said critical velocity defined above and in an amount sufficient to strip previously injected light hydrocarbon from said reservoir oil to form a transition zone of conditional miscibility; and thereafter (c) injecting a driving fluid into said reservoir via said injection system to drive said transition zone through said reservoir and displace oil to said production system and, (d) recovering oil from said production system.

2. The method of claim 1 wherein the velocity of said nitrogen-containing gas is less than said critical velocity by an increment of at least 0.2 feet per day.

3. The method of claim 1 wherein the velocity of said first fluid is less than said critical velocity by an increment of at least 0.2 feet per day.

4. The method of claim 1 wherein the volume of said first fluid injected is in the range of 0.01 to 0.20 pore volume of said reservoir.

5. The method of claim 1 wherein said first fluid is injected into said reservoir in an amount equivalent to the pore volume amount of said reservoir within a radial distance of 5.0 to 50.0 feet from said injection system.

6. The method of claim 1 wherein said nitrogen containing gas is injected in an amount of at least 0.2 pore volume of said reservoir.

7. The method of claim 1 wherein the driving fluid is gaseous.

8. The method of claim 7 wherein the gaseous drive fluid is air.

* * * * *